US007140643B1

(12) United States Patent
Smith

(10) Patent No.: US 7,140,643 B1
(45) Date of Patent: Nov. 28, 2006

(54) APPARATUS AND METHOD FOR TEACHING EARLY LEARNING SKILLS

(76) Inventor: Mildred P. Smith, 109 N. Sams Cir., Stigler, OK (US) 74462

( * ) Notice: Subject to any disclaimer, the term of this patent is extended or adjusted under 35 U.S.C. 154(b) by 0 days.

(21) Appl. No.: 10/857,209

(22) Filed: May 28, 2004

Related U.S. Application Data

(60) Provisional application No. 60/516,447, filed on Nov. 3, 2003.

(51) Int. Cl.
*B42B 5/00* (2006.01)

(52) U.S. Cl. ..... 281/21.1; 402/73

(58) Field of Classification Search ..... 402/73, 402/80 R, 70, 500–503; D19/26–27; 281/21.1; 434/311, 317; *B42B 5/00*
See application file for complete search history.

(56) References Cited

U.S. PATENT DOCUMENTS

| | | | | |
|---|---|---|---|---|
| 364,845 | A | 6/1887 | Oakley | |
| 3,010,228 | A | 11/1961 | Torre | |
| 3,316,669 | A | 5/1967 | Nachbar | |
| 3,491,196 | A | 1/1970 | Stein | |
| 3,715,816 | A | 2/1973 | White | |
| 3,774,319 | A * | 11/1973 | Sprowls | 434/164 |
| 4,006,541 | A | 2/1977 | Miller | |
| 4,063,369 | A * | 12/1977 | Hart | 434/156 |
| 4,072,033 | A * | 2/1978 | Eckerdt | 70/456 B |
| 4,276,031 | A | 6/1981 | Lueck | |
| 4,427,390 | A | 1/1984 | Manger | |
| 4,503,974 | A * | 3/1985 | Lane | 206/457 |
| 4,588,209 | A * | 5/1986 | Zebrowski et al. | 281/45 |
| 4,681,474 | A * | 7/1987 | Wiberg | 402/75 |
| 4,685,885 | A * | 8/1987 | Maddocks | 434/164 |
| 4,702,700 | A | 10/1987 | Taylor | |
| 4,878,844 | A | 11/1989 | Gasper et al. | |
| 5,087,145 | A * | 2/1992 | Cooley | 402/79 |
| 5,120,149 | A * | 6/1992 | Smith | 402/75 |
| 5,351,992 | A * | 10/1994 | Chilson et al. | 281/31 |
| 5,505,624 | A | 4/1996 | Novosel | |
| 5,524,998 | A * | 6/1996 | Schwartz | 402/79 |
| 5,575,503 | A * | 11/1996 | Takahashi | 281/21.1 |
| 5,765,245 | A * | 6/1998 | Breto | 5/640 |
| 5,820,383 | A | 10/1998 | Levins | |
| 5,895,219 | A | 4/1999 | Miller | |
| 5,897,421 | A | 4/1999 | Rink et al. | |
| 5,904,374 | A * | 5/1999 | Lee | 281/29 |
| 5,951,298 | A | 9/1999 | Werzberger | |
| 6,050,824 | A | 4/2000 | Stuart | |
| 6,056,549 | A | 5/2000 | Fletcher | |
| 6,106,302 | A | 8/2000 | Schumacher | |
| 6,682,248 | B1 * | 1/2004 | Lockhart | 402/73 |
| 6,692,029 | B1 * | 2/2004 | Ke | 281/21.1 |
| 6,793,251 | B1 * | 9/2004 | Stark | 281/51 |
| 2003/0006164 | A1 * | 1/2003 | Mateus et al. | 206/701 |
| 2003/0027113 | A1 | 2/2003 | Curtin | |

FOREIGN PATENT DOCUMENTS

| | | | |
|---|---|---|---|
| FR | 2813553 | A3 * | 3/2002 |
| JP | 01306294 | A * | 12/1989 |
| JP | 2003246164 | A * | 9/2003 |

* cited by examiner

*Primary Examiner*—Derris H. Banks
*Assistant Examiner*—J Williams
(74) *Attorney, Agent, or Firm*—Butzel Long

(57) ABSTRACT

A learning tool includes a book binder and a plurality of removable pages. Each of the pages has a mounting surface and/or mounting locations for releasably attaching a plurality of symbol devices formed as letters, numbers and the like.

10 Claims, 5 Drawing Sheets

APPARATUS AND METHOD FOR TEACHING EARLY LEARNING SKILLS

CROSS-REFERENCE TO RELATED APPLICATION

This application claims the benefit of U.S. provisional patent application Ser. No. 60/516,447 filed Nov. 3, 2003.

BACKGROUND OF THE INVENTION

The present invention relates generally to teaching aids and learning tools for children and, in particular, to a book and a tool for teaching early learning skills.

Young children are typically taught to read by associating the names of the letters of the alphabet with the shapes of the letters. Likewise, children may be shown words and taught to associate them with pictures of the objects that the words represent. Some educational toys teach the letters of the alphabet by encouraging the children to physically associate an object shaped like a given letter with a printed representation of the letter. For example, a book is provided having a plurality of pages each with a number of recesses shaped to receive the corresponding letter-shaped objects. The child is encouraged to memorize the shape of the letter and associate the letter-shaped object with the letter-shaped recess in the book.

While such devices are useful, they do present a number of limitations. For example, each recess in the book, while it is similar to the printed word, is not a printed representation. Naturally, the pages of the book themselves present the disadvantage of being relatively expensive to manufacture. In use, the letter-shaped objects are retained in the pages of the book by gravity or friction. When friction is used to retain the letters, the limited area of the letter-shaped object available to the child makes grasping difficult. Similarly, in the event that only gravity is used to retain the letters, movement of the book with the letters in it is likely to result in the letters sliding out of place or falling from the book.

As a solution to these inconveniences, it has been suggested that a separate device be used for storing the letters, which device may either be integral with or separate from the book. Likewise, books have been designed in which natural static electricity is used to adhere the objects to the page. However his method is suitable only for very thin flexible overlays. Such thin objects are difficult for children to grasp and function poorly as teaching devices because their shape is often not retained, due either to inherent flexibility or breakage and wear.

There is shown in the U.S. Pat. No. 4,427,390 an educational book-like toy that includes a plurality of pages wherein letters may be removably adhered over corresponding shapes on colored pages utilizing Velcro hook and loop fasteners.

However, it remains desirable to provide an improved apparatus or device to aid in teaching youngsters to recognize letters, numbers, shapes, colors, as well as learning to read, how to spell, how to perform basic arithmetic and the English language.

SUMMARY OF THE INVENTION

The present invention concerns a learning tool apparatus in the form of a book binder and a plurality of pages. Each of the pages is operable to be removably attached inside the book binder and to another one of the pages on an attachment edge thereof. Each of the pages defines a mounting surface spaced apart from the attachment edge. A plurality of symbol devices is adapted to be affixed to the mounting surfaces on the pages and at least one of the pages has a predetermined mounting location for at least one of the symbol devices.

Thus, the apparatus for teaching early learning skills comprises: a book binder having a spine portion, a front cover connected to an edge of the spine portion by a first hinge and a back cover connected to another edge of the spine portion by a second hinge; a page binder area on an inner surface of the spine portion, the page binder area having first page fastening means; an identification area on an outer surface of the front cover, the identification area having first symbol device fastening means; a plurality of pages removably attached to the page binder area, each of the pages having second page fastening means cooperating with the first page fastening means for selective attachment to and removal from the page binder area, each of the pages including a mounting surface having second symbol device fastening means; and a plurality of symbol devices each having third symbol device fastening means for cooperating with a selected one of the first symbol device fastening means to removably attach the symbol devices to the identification area and the second symbol device fastening means to removably attach the symbol devices to the mounting surface of a selected one of the pages.

Because the pages are removably attached to the book binder and to the other pages, each of the pages may be advantageously ordered, configured, or arranged within the book binder as desired by the user of the learning tool. The symbol devices utilized in the learning tool can include, but are not limited to, uppercase and lowercase letters, numbers, arithmetic symbols, punctuation marks, directional arrows, geometric shapes, common shapes showing different colors, and the like. The symbol devices may be advantageously moved and rearranged during use of the tool to enhance the learning process.

The learning tool apparatus in accordance with the present invention advantageously provides a means for teaching children to recognize letters, numbers, shapes, colors, as well as providing an tool for learning to read, how to spell, and how to perform basic arithmetic.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
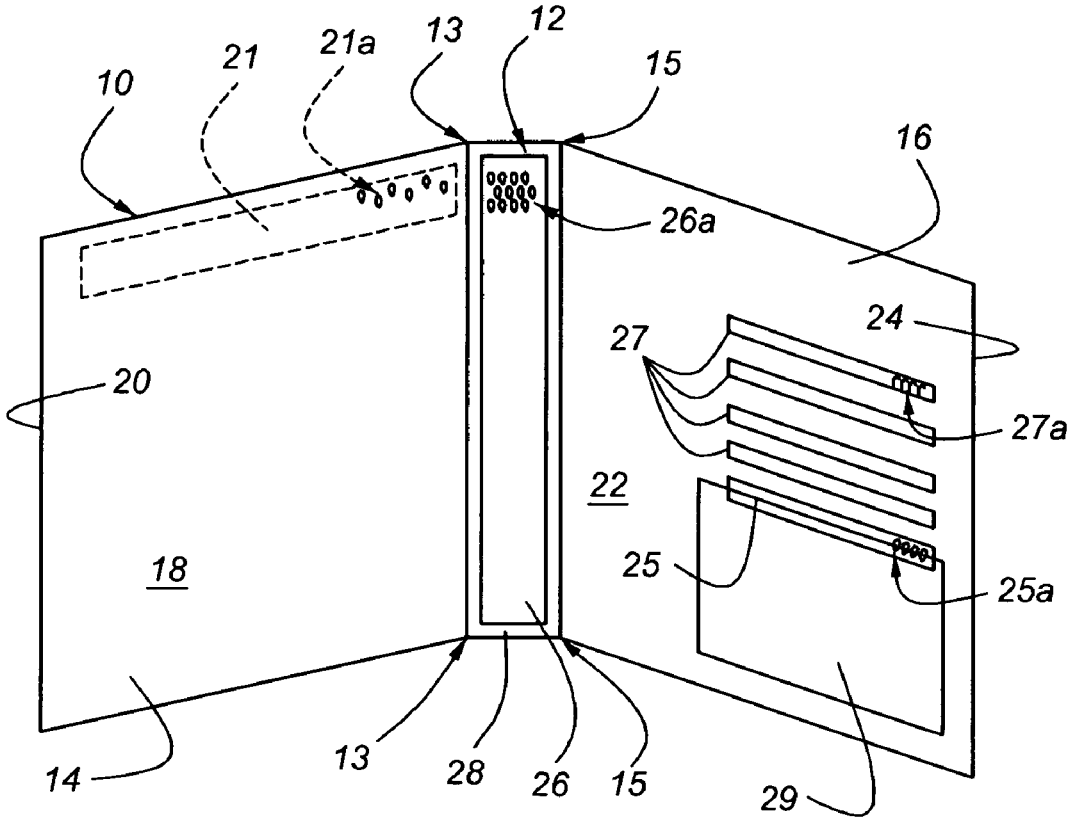
FIG. 1 is a perspective view of a book binding of a learning tool in accordance with the present invention.

Referring now to FIG. 1, a book binder used in a learning book and tool in accordance with the present invention is indicated generally at 10. The binder 10 includes a longitudinally extending spine portion 12 having a front cover 14 and a back cover 16 extending from opposite side edges thereof. The front cover 14 includes an inner surface 18 and an outer surface 20. A generally horizontally extending identification area 21 is formed on or attached to the outer surface 20 and preferably includes a symbol device fastening means 23 in the form of a plurality of loops for personalization as explained below. Typically the loops cover the area 21 and only a few are shown for illustration purposes. The back cover 16 includes an inner surface 22 and an outer surface 24. A hinge 13, such as a living hinge or the like, connects the front cover 14 to the spine portion 12 permitting the front cover to move between an open position as shown and a closed position. A similar hinge 15, such as a living hinge or the like, connects the back cover 16 to the spine portion 12 permitting the rear cover to move between an open position as shown and a closed position.

A longitudinally extending page binder area 26 is formed on or attached to an inner surface 28 of the spine portion 12. The binder area 26 can be a separate piece attached to the inner surface 28 of the spine portion 12 by an adhesive (not shown) or similar attachment means. The binder area 26 preferably covers a large percentage of the inner surface 28 and includes a page fastening means 26*a* preferably formed as a plurality of loops for cooperating with corresponding hooks, discussed in more detail below. Typically the loops cover the area 26 and only a few are shown for illustration purposes. The spine portion 12 and the covers 14 and 16 of the binder 10 are preferably constructed of a relatively rigid plastic material or similar durable, non-toxic material that may preferably be cleaned easily and is suited for use in the learning tool of the present invention.

Figure 2B:
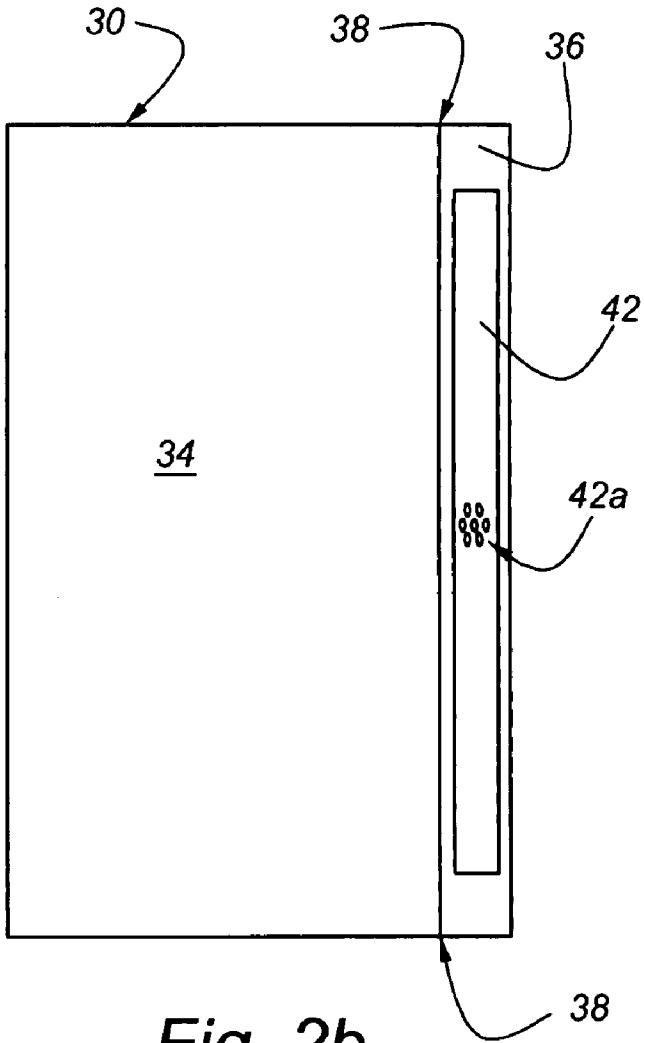
FIGS. 2*a* and 2*b* are front and rear elevation views respectively of a page in accordance with the present invention for use with the binder shown in FIG. 1.
Figure 2A:
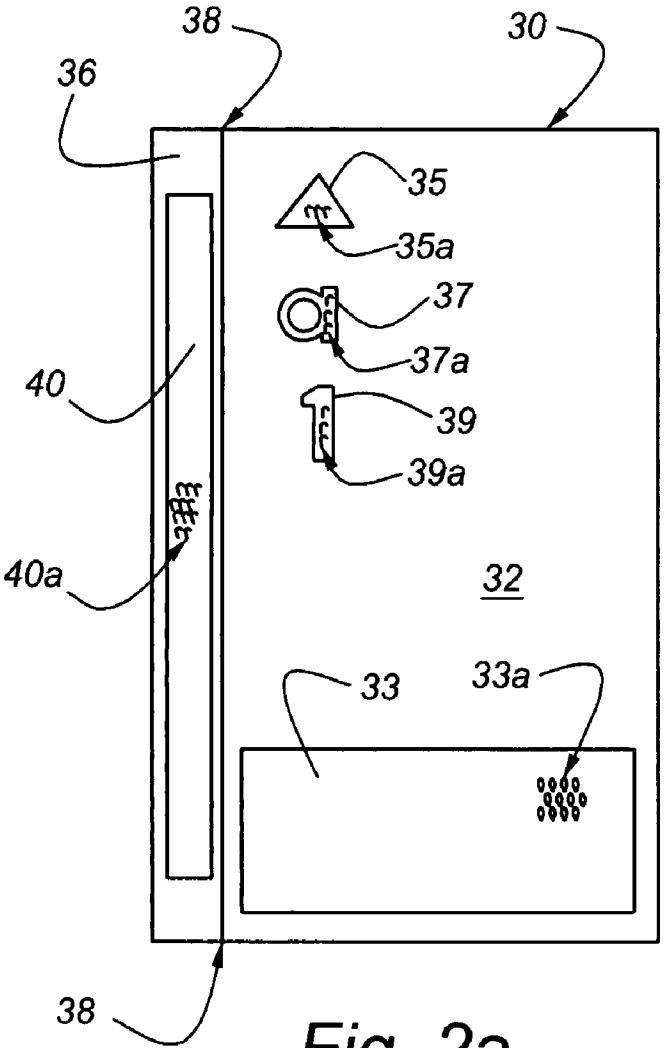

Referring now to FIGS. 2*a* and 2*b*, a page for the learning tool in accordance with the present invention is indicated generally at 30. The page 30 includes a first or front side 32 and a second or rear side 34 and an attachment edge portion 36. A hinge 38, such as a living hinge or the like, connects the edge portion 36 with the remainder of the page 30 to permit the page to be "turned" with respect to the attachment edge 36. A first longitudinally extending fastening element or strip 40 is disposed on the attachment edge 36 on the first side 32 of the page 30. A second longitudinally extending fastening element or strip 42 is disposed on the attachment edge 36 on the second side 34 of the page 30. Preferably, the fastening element 40 has a page fastening means 41 in the form of a plurality of hooks, and the fastening element 42 has a page fastening means 43 formed as a plurality of loops. Typically the hooks cover the area 40 and the loops cover the area 42 and only a few of each are shown for illustration purposes. Thus, the fastening element 40 has hooks operable to attach to the binder area 26 on the spine portion 12 of the binder 10. The other fastening element 42 not attached to the binder area 26 is operable to attach to another fastening element on another similar page of the learning tool, as discussed in more detail below.

As shown in FIG. 1, the inner surface 22 of the back cover 16 can also include predetermined mounting locations for smaller book pages. For example, the inner surface 22 of the back cover 16 can have a plurality of horizontally extending, vertically spaced fastening elements or strips 27 thereon each having a page fastening means 27*a* in the form of a plurality of hooks. A set of smaller pages, represented by a smaller page 29, can be releasably mounted with one page per strip 27. The smaller pages 29 have strips 25 on both sides each having a page fastening means 25*a* in the form of a plurality of loops. Typically the hooks cover the strips 27 and the loops cover the strips 25 and only a few of each are shown for illustration purposes. Thus, the pages 29 can be removed from the back cover 16 and used by the child as guides in performing learning tasks involving the symbol devices and the larger pages which may be advantageously configured in the binder 10 to correspond to lessons in the book collection and further enhance the learning experience for the child.

As shown in FIG. 2*a*, the front side 32 of the page 30 can have a mounting surface 33 in a lower portion thereof. The surface 33 has a symbol device fastening means 33*a* in the form of a plurality of loops. A plurality of mounting locations 35, 37 and 39 are provided in an upper portion of the front side 32, which locations merely are representative in terms of numbers, shapes and sizes. For example, the mounting location 35 is formed as a triangle that is representative of various geometric shapes to be learned. The mounting location 37 is formed as the lowercase letter "a" that is representative of letters of the alphabet to be learned. The mounting location 39 is formed as the number "1" that is representative of numbers and arithmetic operators to be learned. The mounting locations 35, 37 and 39 have a symbol device fastening means 35*a*, 37*a* and 39*a* respectively in the form of a plurality of loops. Typically the loops cover the mounting locations and only a few are shown for illustration purposes.

Figure 3:
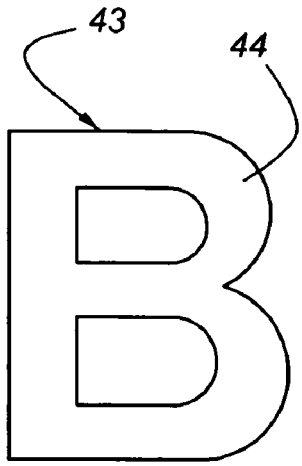
FIG. 3 is a front elevation view of a symbol for use with the learning tool in accordance with the present invention.
Figure 4:
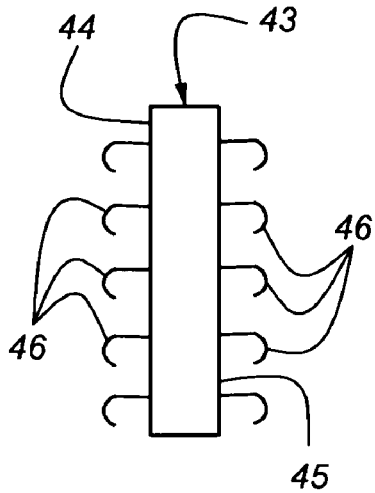
FIG. 4 is a side elevation view of the symbol shown in FIG. 3 taken along the line 4—4.
Figure 5:
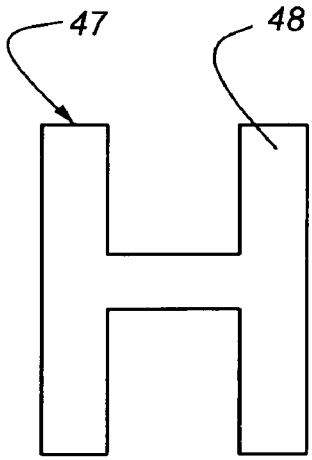
FIG. 5 is a front elevation view of an alternate symbol for use with the learning tool in accordance with the present invention.
Figure 6:
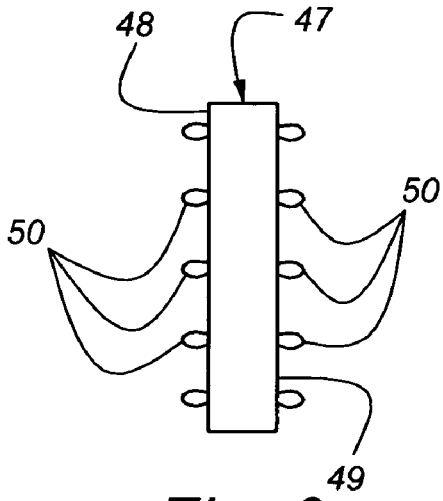
FIG. 6 is a side elevation view of the symbol shown in FIG. 5 taken along the line 6—6.

Referring now to FIGS. 3 and 4, there is shown a symbol device 43 formed, for example, as an uppercase or capital letter 'B' for use with the learning tool in accordance with the present invention. The symbol device 43 is preferably constructed of Velcro material or a similar material and includes a symbol device fastening means 46, in the form of a plurality of hooks, disposed on a front or display surface 44 and a rear or mounting surface 45 thereof, best seen in FIG. 4. Referring now to FIGS. 5 and 6, an alternative embodiment of a symbol device 47 for the uppercase letter 'H' is shown. The symbol device 47 is preferably constructed of Velcro material or a similar material and includes a symbol device fastening means 50, in the form of a plurality of loops, disposed on a front or display surface 48 and rear or mounting surface 49 thereof, best seen in FIG. 6. Clearly, the symbol devices 43 and 47 can have hooks on one side and loops on the other side.

Figure 7B:
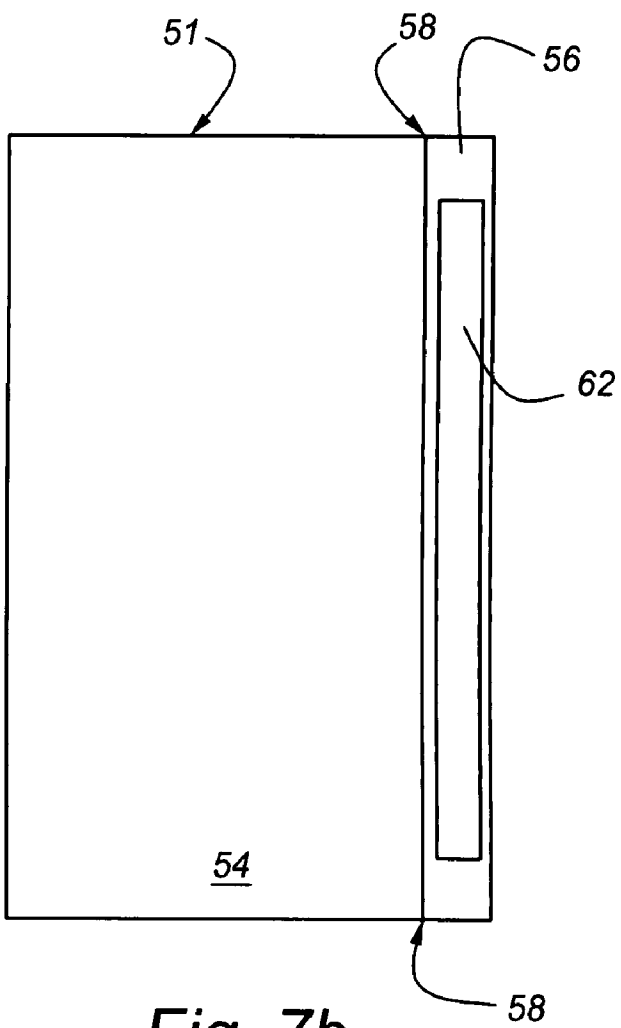
FIGS. 7*a* and 7*b* are front and rear elevation views respectively of an alternative embodiment page in accordance with the present invention.
Figure 7A:
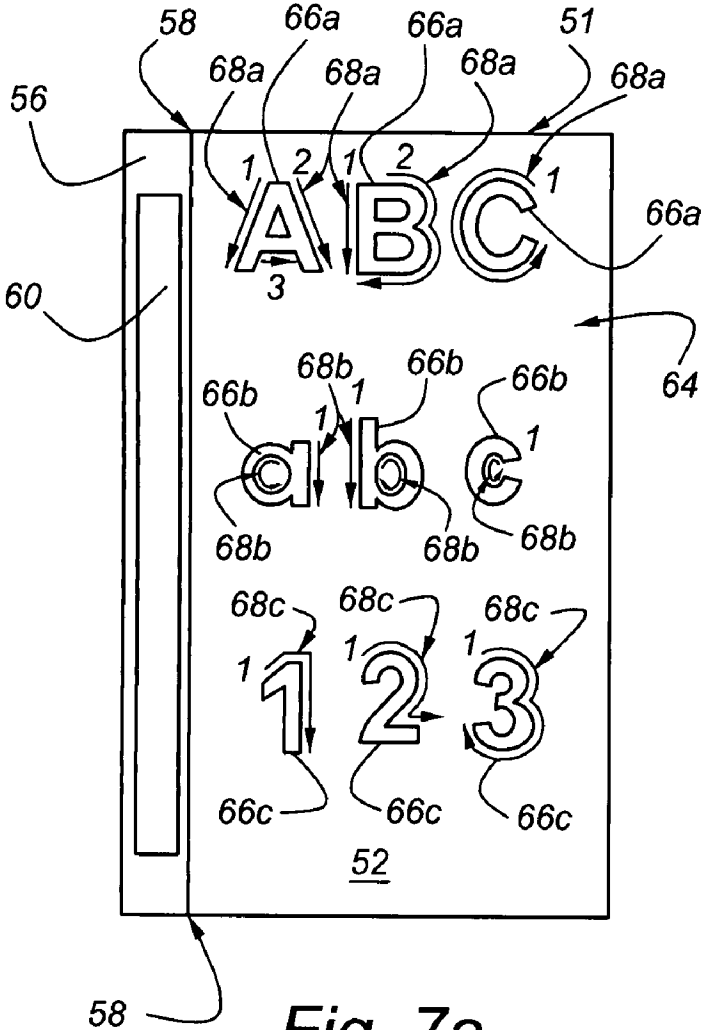

Referring now to FIGS. 7*a* and 7*b*, a page for the learning tool in accordance with the present invention is indicated generally at 51. The page 51 includes a first side 52 and a second side 54 and an attachment edge portion 56. A hinge 58, such as a living hinge or the like, connects the attachment edge 56 to the remainder of the page 51. A first fastening element or strip 60, similar to the fastening element 40 of FIG. 2*a*, is disposed on the attachment edge 56 on the first side 52 of the page 51. A second fastening element 62, similar to the fastening element 42 of FIG. 2*b*, is disposed on the attachment edge 56 on the second side 54 of the page 51. Thus, the fastening element 60 is operable to attach to the binder area 26 on the spine portion 12 of the binding 10. The other the fastening element 62 is operable to attach to another fastening element, such as the element 42 on the page 30 of the learning tool, discussed in more detail below.

The first side 52 of the page 51 defines a mounting surface, indicated generally at 64. The mounting surface 64 includes a plurality of predetermined mounting locations 66*a*, 66*b*, and 66*c* each for attaching an associated symbol device, such as the symbol device 43 of FIGS. 3 and 4 or the symbol device 47 of FIGS. 5 and 6 thereto. The predetermined mounting locations 66*a*, 66*b*, and 66*c* are shaped to conform to the profile of the associated symbol device, such as the center mounting location 66*a* being in the shape of the capital letter "B" to correspond to the symbol device 43. Adjacent each of the predetermined mounting locations 66*a*, 66*b*, and 66*c* there is provided at least one writing aid instruction line that is formed as an arrow to assist a child to learn to write upper case letters, such as the lines 68*a*, lower case letters, such as the lines 68*b*, and/or numbers, such as the lines 68*c*. Other predetermined mounting locations can be included on the mounting surface 64 including, but not limited to, mounting locations for arithmetic symbols, punctuation marks, directional arrows, geometric shapes, common shapes showing different colors, and the like. These additional predetermined mounting locations may also include a writing aid instruction lines located adjacent thereto. Those skilled in the art will appreciate that greater or fewer predetermined mounting locations, such as the mounting locations 68*a*, 68*b*, and 68*c*, may be included on the mounting surface 64 and the mounting locations may be sized to include, for example, an entire uppercase and/or lowercase alphabet, all numerals zero through nine, while remaining within the scope of the present invention. Those skilled in the art will appreciate that the symbol devices may all include hooks, such as the hooks 46 of FIG. 4, may all include loops, such as the loops 50 of FIG. 6, or any combination thereof and the mounting locations, such as the mounting locations 68*a*, 68*b*, and 68*c*, will be configured with the symbol device fastening means described above in the form of hooks or loops as required to accept each of the symbol devices.

Figure 8B:
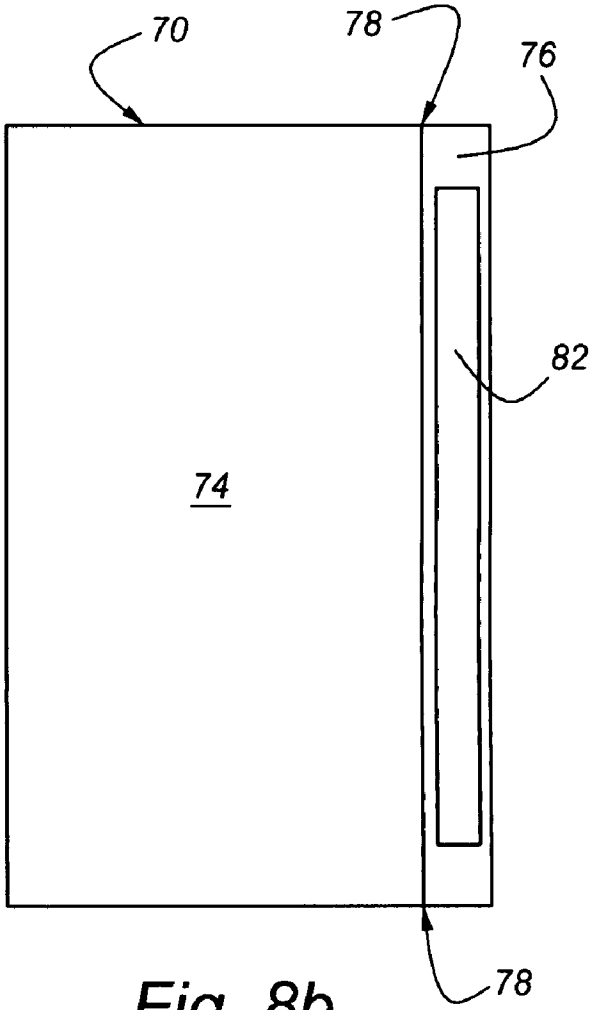
FIGS. 8*a* and 8*b* are front and rear elevation views respectively of another alternative embodiment page in accordance with the present invention.
Figure 8A:
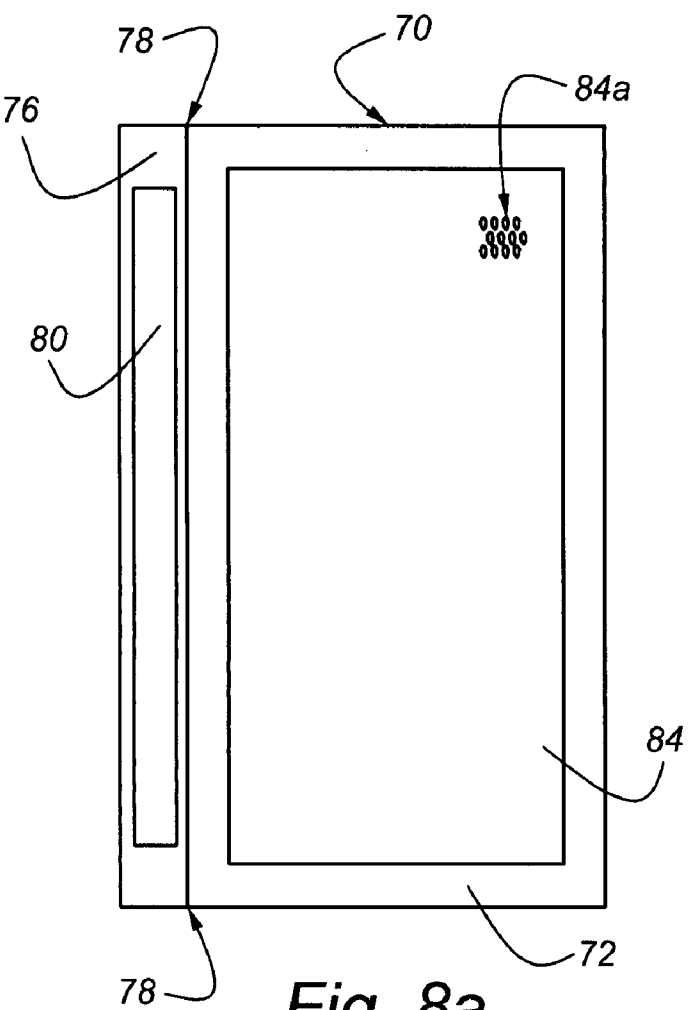

Referring now to FIGS. 8*a* and 8*b*, a page for the learning tool in accordance with the present invention is indicated generally at 70. The page 70 includes a first side 72 and a second side 74 and an attachment edge portion 76. A hinge 78, such as a living hinge or the like, connects the attachment edge portion 76 to the remainder of the page 70. A first fastening element or strip 80, similar to the fastening element 40 of FIG. 2*a*, is disposed on the attachment edge 76 on the first side 72 of the page 70. A second fastening element or strip 82, similar to the fastening element 42 of FIG. 2*b*, is disposed on the attachment edge 76 on the second side 74 of the page 70. Preferably, the fastening element 80 includes a plurality of hooks, and the fastening element 82 includes a plurality of loops. The fastening element 80 is operable to attach to the binder area 26 on the spine portion 12 of the binding 10. The element 82 is operable to attach to another fastening element on another page of the learning tool, as discussed in more detail below.

The first side 72 of the page 70 defines a mounting surface, indicated generally at 84. The mounting surface 84 covers a large percentage of the first side 72 of the page 70. Preferably, the mounting surface 84 is formed with a symbol device fastening means 84*a* including a plurality of loops for cooperating with hooks, such as the hooks 46 of the symbol device 43. Alternatively, the mounting surface 84 is formed with a plurality of hooks for cooperating with loops, such as the loops 50 of the symbol device 47. The mounting surface 84 advantageously allows a plurality of symbol devices, such as the symbol device 43 and the symbol device 47 to be placed thereon with no particular ordering or locating requirement, allowing the child to form words, sentences, display shapes and arrows, and perform basic arithmetic, etc by moving the symbols from other pages to the mounting surface 84.

The learning tool in accordance with the present invention can be assembled from the above-described components as follows. The page 30 can be selected to be a first page for the learning tool. The fastening element 40 (hooks) of the page 30 is removably attached to the binder area 26 (loops) of the book binder 10 allowing the page 30 to be turned at the hinge 38. After the page 30 is attached to the book binder 10, the page 51 is removably attached to the page 30 by attaching the fastening element 60 (hooks) to the fastening element 42 (loops) of the page 30. When attached, the page 51 can be turned at the hinge 58. After the page 51 is attached to the page 30, the page 70 is removably attached to the page 51 by attaching the fastening element 80 (hooks) to the fastening element 62 (loops) of the page 51. When attached, the page 70 can be turned at the hinge 78. When attached and assembled as described above, the pages 30, 51, and 70 and the book binder 10 form a learning tool in accordance with the present invention and each of the pages 30, 51, and 70 are operable to turn at their respective hinges 38, 58, and 78 to allow for the user of the learning tool to easily turn the pages 30, 51, and 70 during use of the learning tool. Those skilled in the art will appreciate that any number of the pages 30, 51, 70 can be attached to the book binder 10 and any number of the symbol devices can be attached to the pages to form a single page or multiple page learning tool while remaining within the scope of the present invention. Moreover, because each of the pages 30, 51, and 70 are removably attached, the pages 30, 51, and 70 may be advantageously ordered, configured, or arranged within the book binder 10 as desired by the user of the learning tool.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for teaching early learning skills comprising:

a book binder having a spine portion, a front cover connected to an edge of said spine portion by a first hinge and a back cover connected to another edge of said spine portion by a second hinge;

a page binder area on an inner surface of said spine portion, said page binder area having a page fastening means;

a plurality of pages removably attached to said book binder, each of said pages having an attachment edge portion extending along an edge of said page and being connected to a remainder of said page by an edge hinge, each of said pages having a first page fastening means disposed on said attachment edge portion for cooperating with said page binder area page fastening means for selective attachment to and removal from said page binder area, each of said pages including a mounting surface having a symbol device fastening means, wherein each of said pages has a second page fastening means disposed on said attachment edge portion for cooperating with said first page fastening means of another one of said pages to removably attach two of said pages together, whereby when said plurality of pages is attached to said book binder, a first one of said pages is attached to said page binder area page fastening means by said first page fastening means and each other one of said pages is attached by said first page fastening means to said second page fastening means of another one of said plurality of pages, and whereby each of said pages can be turned at said edge hinge and only one page of said plurality of pages can be removed from said book binder without removing at least another page of said plurality of pages; and a plurality of symbol devices each having a symbol device fastening means for cooperating with said mounting surface symbol device fastening means to removably attach said symbol devices to said mounting surface of a selected one of said pages.

2. The apparatus according to claim 1 wherein said page binder area page fastening means includes a plurality of loops and said first page fastening means of said pages includes a plurality of hooks.

3. The apparatus according to claim 1 including a plurality of smaller pages removably attached to an inside surface of said back cover.

4. The apparatus according to claim 1 wherein at least one of said pages has a plurality of mounting locations each shaped to correspond to an associated one of said symbol devices and including symbol device fastening means for removably attaching said associated one symbol device.

5. The apparatus according to claim 1 wherein said at least one page has writing aid lines adjacent said mounting locations.

6. The apparatus according to claim 1 wherein said symbol devices are shaped as at least one of uppercase letters, lowercase letters, geometric shapes, numbers and arithmetic operators.

7. An apparatus for teaching early learning skills comprising:

a book binder having a spine portion, a front cover connected to an edge of said spine portion by a first hinge and a back cover connected to another edge of said spine portion by a second hinge;

a page binder area on an inner surface of said spine portion, said page binder area having a page fastening means formed of one of a hook material and a loop material;

an identification area on an outer surface of said front cover, said identification area being substantially smaller than an area of said outer surface and having a symbol device fastening means formed of one of a hook material and a loop material;

a plurality of full size pages removably attached to said book binder, each of said full size pages having an attachment edge portion extending along an edge of said full size page and being connected to a remainder of said page by an edge hinge, each of said full size pages having a first page fastening means disposed on said attachment edge for cooperating with said page binder area page fastening means for selective attachment to and removal from said page binder area, each of said full size pages including a mounting surface having a symbol device fastening means formed of one of a hook material and a loop material, each of said full size pages having a second page fastening means disposed on said attachment edge portion for cooperating with said first page fastening means of another one of said full size pages to removably attach two of said full size pages together, whereby when said plurality of full size pages is attached to said book binder, a first one of said full size pages is attached to said page binder area page fastening means by said first page fastening means and each other one of said full size pages is attached by said first page fastening means to said second page fastening means of another one of said plurality of full size pages, and whereby each of said full size pages can be turned at said edge hinge and only one full size page of said plurality of full size pages can be removed from said book binder without removing at least another full size page of said plurality of full size pages;

a plurality of smaller pages each removably attached to an inside surface of said back cover; and a plurality of symbol devices each having a symbol device fastening means for cooperating with a selected one of said identification area symbol device fastening means to removably attach said symbol devices to said identification area and said mounting surface symbol device fastening means to removably attach said symbol devices to said mounting surface of a selected one of said pages.

8. The apparatus according to claim 7 wherein at least one of said full size pages has a plurality of mounting locations each shaped to correspond to an associated one of said symbol devices and including symbol device fastening means for removably attaching said associated one symbol device.

9. The apparatus according to claim 8 wherein said at least one page has writing aid lines adjacent said mounting locations.

10. The apparatus according to claim 7 wherein said symbol devices are shaped as at least one of uppercase letters, lowercase letters, geometric shapes, numbers and arithmetic operators.

* * * * *